US009617760B2

(12) United States Patent
Dragon et al.

(10) Patent No.: US 9,617,760 B2
(45) Date of Patent: Apr. 11, 2017

(54) LOCK HAVING A MODIFIED SPRING LIP FOR MOTOR VEHICLE DOORS

(75) Inventors: Marek Dragon, Waldbröl (DE); Klaus Götzen, Mülheim (DE); Thomas Waldmann, Mülheim (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 200 days.

(21) Appl. No.: 14/004,219

(22) PCT Filed: Nov. 8, 2011

(86) PCT No.: PCT/DE2011/001951
§ 371 (c)(1),
(2), (4) Date: Sep. 10, 2013

(87) PCT Pub. No.: WO2012/065593
PCT Pub. Date: May 24, 2012

(65) Prior Publication Data

US 2014/0021724 A1 Jan. 23, 2014

(30) Foreign Application Priority Data

Nov. 20, 2010 (DE) ..... 20 2010 015 710 U

(51) Int. Cl.
*E05C 3/16* (2006.01)
*E05B 77/36* (2014.01)
(Continued)

(52) U.S. Cl.
CPC ..... *E05B 77/36* (2013.01); *E05B 77/38* (2013.01); *E05B 85/26* (2013.01);
(Continued)

(58) Field of Classification Search
CPC ..... E05B 17/0045; E05B 2015/0458; E05B 2015/0468; E05B 77/36; E05B 77/38; E05B 77/40; E05B 77/42; E05B 85/26
(Continued)

(56) References Cited

U.S. PATENT DOCUMENTS 2,159,315 A * 5/1939 Blue ..... 292/2
3,997,202 A * 12/1976 Tack et al. ..... 292/216
(Continued)

FOREIGN PATENT DOCUMENTS

DE 8915280 U1 2/1990
DE 19824466 A1 12/1999
(Continued)

OTHER PUBLICATIONS

Computer Generated Translation for DE102008058419, Translated on Feb. 7, 2015.*
(Continued)

*Primary Examiner* — Alyson M Merlino
(74) *Attorney, Agent, or Firm* — Renner, Otto, Boisselle & Sklar, LLP

(57) ABSTRACT

The invention relates to a lock for a motor vehicle or a building, said lock being equipped with a rotary latch (2) rotatably supported in the lock housing (10) about a locking bolt (3), wherein the lock housing (10) has a slotted guide (8) for the locking bolt (3), said slotted guide having at least one spring lip (15) on the insertion side, which spring lip reaches into the slotted guide and cushions the locking bolt (3), said spring lip having creaking protection (17) that partially covers the surface (16) of the spring lip, wherein the spring lip (15) has a bounding bead (20) at the free end (18) and wherein the creaking protection (17) is designed as a sheet metal clamp (21) that can be attached to the spring lip (15) in front of the bounding bead with a preload.

11 Claims, 3 Drawing Sheets

(51) Int. Cl.
*E05B 77/38* (2014.01)
*E05B 85/26* (2014.01)
*E05B 15/04* (2006.01)

(52) U.S. Cl.
CPC ..... *E05B 2015/0458* (2013.01); *E05B 2015/0468* (2013.01); *Y10T 292/0911* (2015.04)

(58) Field of Classification Search
USPC ..... 292/201, 216, 219, DIG. 23, DIG. 51, 292/DIG. 56, DIG. 57, DIG. 58, DIG. 73
See application file for complete search history.

(56) References Cited

U.S. PATENT DOCUMENTS

| | | | | | |
|---|---|---|---|---|---|
| 4,097,078 | A * | 6/1978 | Tack et al. | ..... | 292/216 |
| 4,165,112 | A * | 8/1979 | Kleefeldt | ..... | 292/216 |
| 4,756,563 | A * | 7/1988 | Garwood et al. | ..... | 292/216 |
| 4,896,908 | A * | 1/1990 | Kleefeldt | ..... | 292/216 |
| 5,071,178 | A * | 12/1991 | Brackman et al. | ..... | 292/216 |
| 5,570,915 | A * | 11/1996 | Asadurian | ..... | 292/242 |
| 6,349,983 | B1 * | 2/2002 | Dupont et al. | ..... | 292/201 |
| 2012/0161455 | A1 * | 6/2012 | Meyer et al. | ..... | 292/219 |
| 2014/0291999 | A1 * | 10/2014 | Graute et al. | ..... | 292/96 |

FOREIGN PATENT DOCUMENTS

| | | | |
|---|---|---|---|
| DE | 10216313 | A1 * | 10/2003 |
| DE | 10320457 | A1 * | 12/2004 |
| DE | 102004031266 | A1 * | 1/2006 |
| DE | 102006028423 | A1 * | 12/2007 |
| DE | 102008058419 | A1 | 5/2010 |
| DE | 102009032894 | A1 * | 1/2011 |
| DE | 202009013269 | U1 * | 3/2011 |
| DE | 102009051529 | A1 * | 5/2011 |
| JP | 53138127 | A * | 12/1978 |
| WO | 2006/133673 | | 12/2006 |

OTHER PUBLICATIONS

Computer Generated Translation for DE10215691, Translated on Feb. 7, 2015.*
International Search Report corresponding to PCT/DE2011/001951 dated May 8, 2012.
Written Opinion of International Searching Authority corresponding to PCT/DE2011/001951 dated May 20, 2013.

* cited by examiner

Kiekert
6
2
5
10
15
3
11
9
8
4
7
1

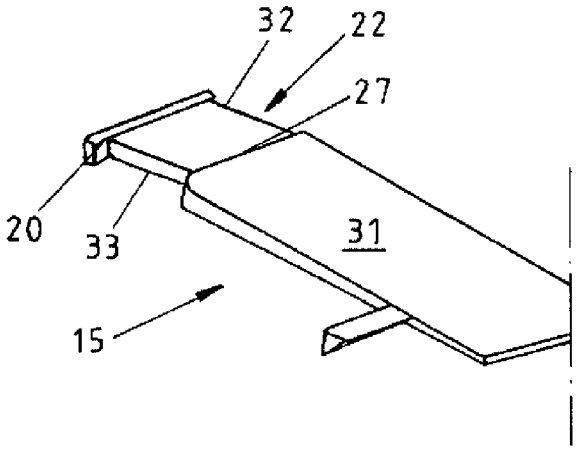
Fig.4
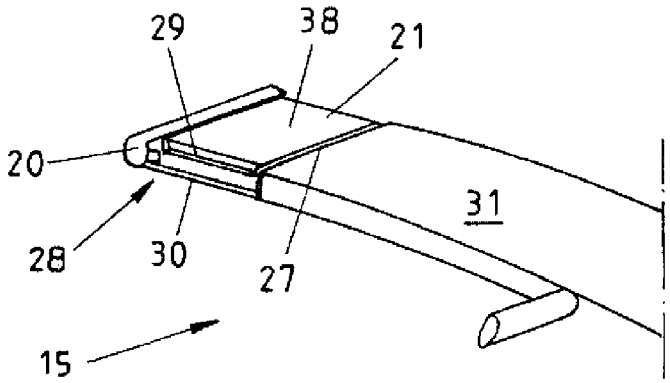
Fig.5
Fig.7
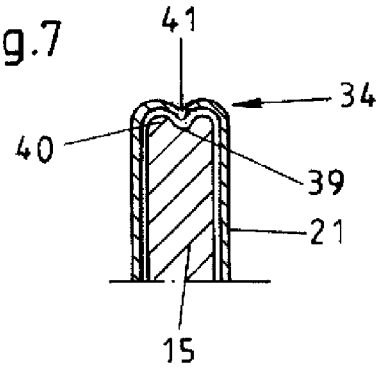
Fig.6
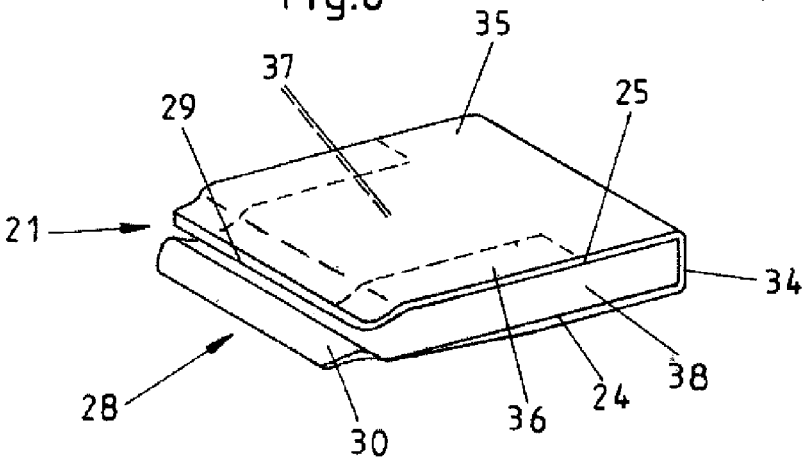

LOCK HAVING A MODIFIED SPRING LIP FOR MOTOR VEHICLE DOORS

FIELD OF THE INVENTION

The invention relates to a lock for a motor vehicle or a building, said lock being equipped with a rotary latch rotatably supported in the lock housing about a locking bolt, wherein the lock housing has a slotted guide for the locking bolt, said locking bolt having at least one spring lip on the insertion side, which spring lip reaches into the slotted guide and cushions the locking bolt, said spring lip having creaking protection that partially covers the surface.

BACKGROUND OF THE INVENTION

In particular in case of locks installed or arranged in moving parts such relative movements between individual parts can generate noise which should generally be avoided for reasons of comfort. Prior art provides several solutions combating this unwanted noise. This is particularly significant for motor vehicles as, during driving, said creaking noises can be generated in particular between the rotary latch and locking bolt. In DE 102 16 313 A1, DE 10 2004 031 266 A1 and DE 10 2006 028 423 A1 the contact points between the rotary latch and locking bolt are provided with a noise damping layer which, at the same time, also aims to reduce wear. DE 10 2004 031 266 A1 describes the arrangement of a spring element or of a spring lip in the lock, also acting on the locking bolt in the closed position. The spring element or the spring lip is preloaded when the locking bolt is inserted. DE 103 20 457 A1 also describes such a spring lip that can be moulded onto the retaining leg for said locking bolt. These known spring lips can also not fully eliminate the creaking noise in the closed position. In DE 2009 032 894.7, not published as yet, the creaking noise has been finally eliminated by the spring lip being equipped with a creaking protection. The suggested creaking protection is a metal plate or profile element slid onto the spring lip.

SUMMARY OF THE INVENTION

The invention has the task of simplifying the production and assembly of the creaking protection designed as an element covering the spring lip.

The invention solves this task by the spring lip containing a bounding bead at its free end and the creaking protection being designed as a metal clamp attachable to the spring lip with preloading.

A spring lip narrowing in this way the insertion slot into the slotted guide can be appropriately and easily equipped with the creaking protection. The metal clamp is slid onto the spring lip in its transverse axis, assuming a position from which it cannot be displaced because of the bounding bead of the spring lip. Once slid on, the metal clamp can also not be accidentally slid off by multiple insertion of the locking bolt but is then effectively and permanently retained by the bounding bead formed at the free end of the spring lip.

According to a respective embodiment of the invention, the spring lip is formed to contain a seat area for the metal clamp and a respective smaller cross section in this seat area. This form of the spring lip ensures that once slid on, the metal clamp does not protrude over the wall of the spring lip but produces a continuous wall, ensuring that the locking bolt can be smoothly slid past or forward during the closing operation of the lock. Once the locking bolt has assumed its end position in the slotted guide, the metal surfaces of the locking bolt and of the metal clamp abut so that no or only faint creaking noises are audible.

According to a further development of the invention, the sliding of the metal clamp onto the spring lip is facilitated by the fact that said metal clamp contains two flexible flanks. This allows the metal clamp to be easily and securely slid onto the spring lip, with the flexible flanks of the metal clamp ensuring that the position, once assumed, is also reliably retained, as the respective flanks press against the body of the spring lip.

The secure seat of the metal clamp is improved even further by the fact that the seat area of the metal clamp is restricted on one hand at the end by the bounding bead and on the other hand, in the direction of the stop, by the edge on the lock housing. It has already been pointed out above that the created seat area for the metal clamp ensures that the metal clamp does not protrude over the cross section of the spring lip. At the same time, the reached edge also ensures that the metal clamp assumes a secure position once pushed into position or pushed past the seat area.

Whilst the respectively formed seat area prevents displacement of the metal clamp in longitudinal direction of the spring lip, the seat is also optimised in the direction of the transverse axis by the metal clamp containing bent down latching edges on both sides at its open end. At the same time, the flanks with these latching edges ensure that it is easier to slide the clamp onto the spring lip as the ledging edges are bent outwardly for this purpose.

The invention achieves the engaging of the latching edges as well as a conforming seat in the area of the back of the metal clamp due to the fact that the spring lip contains a recess on both sides of the seat area of the metal clamp, dimensioned in accordance with the thickness of the metal on the back of the metal clamp and in accordance with the dimensions of the latching edges at the open end. After final assembly, the metal clamp is thus positioned in such a way that it does not protrude over the dimensions of the spring lip at any point but is precisely adapted to assume its seat so that the metal clamp does not jam or even come undone when the locking bolt is inserted or the clamp is acted upon otherwise.

The spring action of the flanks of the metal clamp facilitates assembly if the width of a flank of the metal clamp reduces towards the open end. This makes it easier to slide on the clamp without affecting the secure seat.

This narrowing of the one flank is expediently achieved by the flank having a varying width, i.e. a full width in the top third starting from the back and a width preferably reduced to 66% in the two remaining thirds forming a centre web. With optimised spring effect, the reliable sliding on and exact fit of the metal clamp in the shape of the spring lip is definitely ensured.

In the invention the metal locking bolt is securely supported by the spring lip as the flank of the metal clamp, with the unchanged width extending up to the open end, is arranged on the side of the spring lip facing the locking bolt. The part of the metal clamp containing a continuous width is thus attached and arranged on the side of the spring lip on which the locking bolt is slid past and where, in its end position, it comes into contact with the metal clamp. In this way the objective of reliably avoiding the creaking noise is achieved.

Another embodiment of the invention aims to further secure the assumed seat position of the metal clamp on or about the spring lip, which is achieved by the spring lip containing a longitudinal groove in the seat area of the back of the metal clamp and the metal clamp containing a corresponding bead. At the same time, the bead additionally stabilises the metal clamp so that, all in all, the position for the metal clamp slid onto the spring lip is secured.

A long service life of such metal clamps as well as the required flexible effect are in particular ensured if the metal clamp is, according to the invention, made from thin stainless steel.

The particular inventive step of the invention is that it provides a solution for the known creaking protection, characterised by a simple installation and production. The creaking protection consists of a metal clamp which can be slid onto the spring lip from the top or in the direction of the transverse axis. Due to its shape and the shape of the spring lip it engages in such a way that during further operation and, in particular, when moving along and applying the locking bolt there is no danger that the metal clamp moves or can be moved out of its assumed position. Even during a long service life, as can be expected in practical application, its seat and thus a precise contact between spring lip and locking bolt is ensured.

BRIEF DESCRIPTION OF THE DRAWINGS

Further details and advantages provided by the invention are provided in the below description relating to the respective drawings, showing a preferred embodiment with the required details and spare parts, in which:

FIG. 4 shows an individual view of the spring lip without metal clamp,

FIG. 5 shows the spring lip of FIG. 4 with clipped-on metal clamp,

FIG. 6 shows an individual perspective view of the spring lip and

FIG. 7 shows a sectional cut through the spring lip and metal clamp.

DETAILED DESCRIPTION OF THE INVENTION

Figure 1:
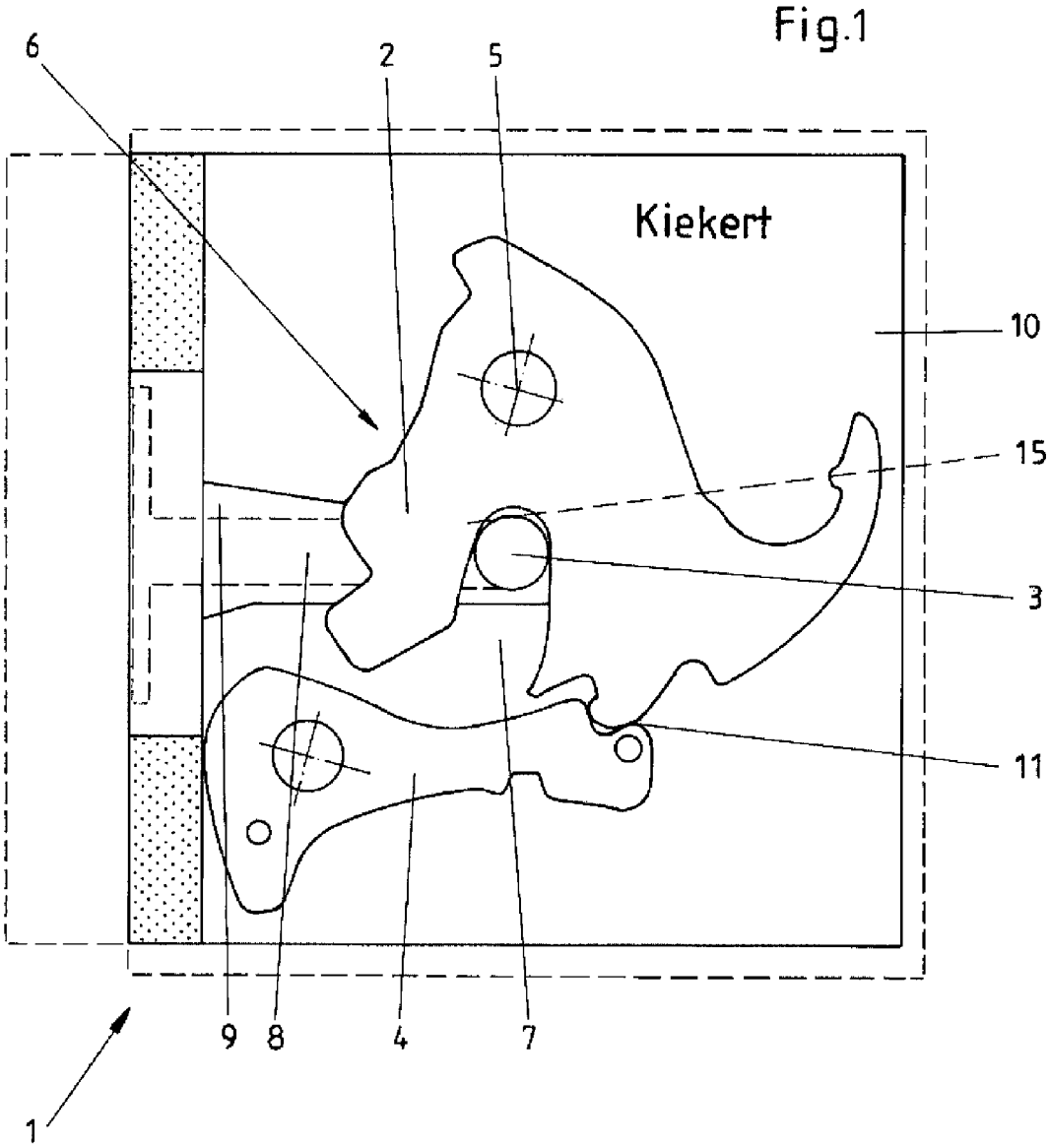
FIG. 1 shows a top view onto a simplified version of the lock.

FIG. 1 shows a lock 1, in this case a motor vehicle lock, equipped with a locking mechanism 6 comprising a rotary latch 2 and pawl 4. The rotary latch 2 containing an infeed section 7 encloses the locking bolt 3 in the shown closed position and can be pivoted around the pivot axis 5. To secure this position, the pawl 4 has been pivoted in such a way that its projection 11 abuts against the rotary latch 2 and that in the area of a recess a specific and precisely defined contact area is created, preventing the rotary latch 2 from pivoting back. All parts of this lock are arranged in the lock housing 10 containing a slotted guide 8 for the locking bolt 3 whose entry side is identified by numeral 9.

The rotary latch 2 generally has a plastic cover, with the contact area of the rotary latch 2 generally being kept away from the cover by means of the locking bolt 3, allowing a metal-to-metal contact to be produced, when the pawl 4 has been engaged. The pawl 4 can also have such a cover.

The exact position of the spring lip 15 described below is not shown in FIG. 1. Its seat is only indicated by the dashed/dotted line.

Figure 2:
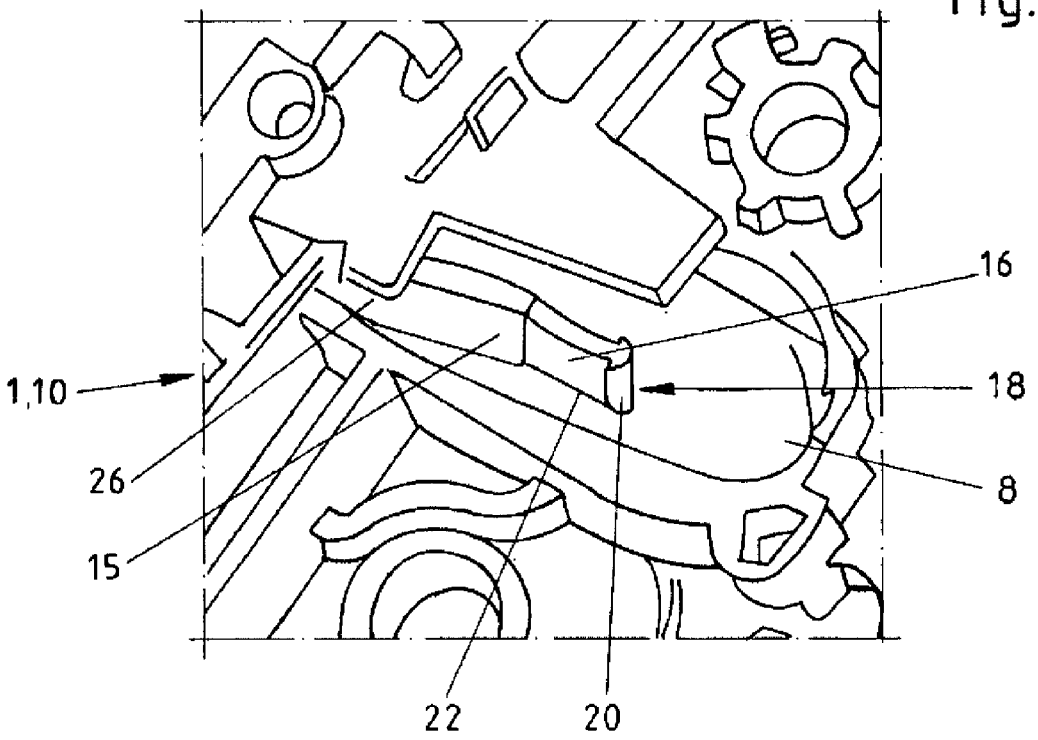
FIG. 2 shows a partial view with the spring lip not covered.

FIG. 2 shows the seat of the spring lip 15 within the slotted guide 8. The figure shows that the end section of the slotted guide 8 forms a semi circle and that the spring lip 15 projects into this semi circle. The end of the spring lip is fixed to the lock housing 10 and is flexible. A recess is indicated at the free end 18 of the spring lip 15, which is explained below and which serves to accommodate a so-called creaking protection 17, covering the surface 16 of the spring lip 15 in this area.

Figure 3:
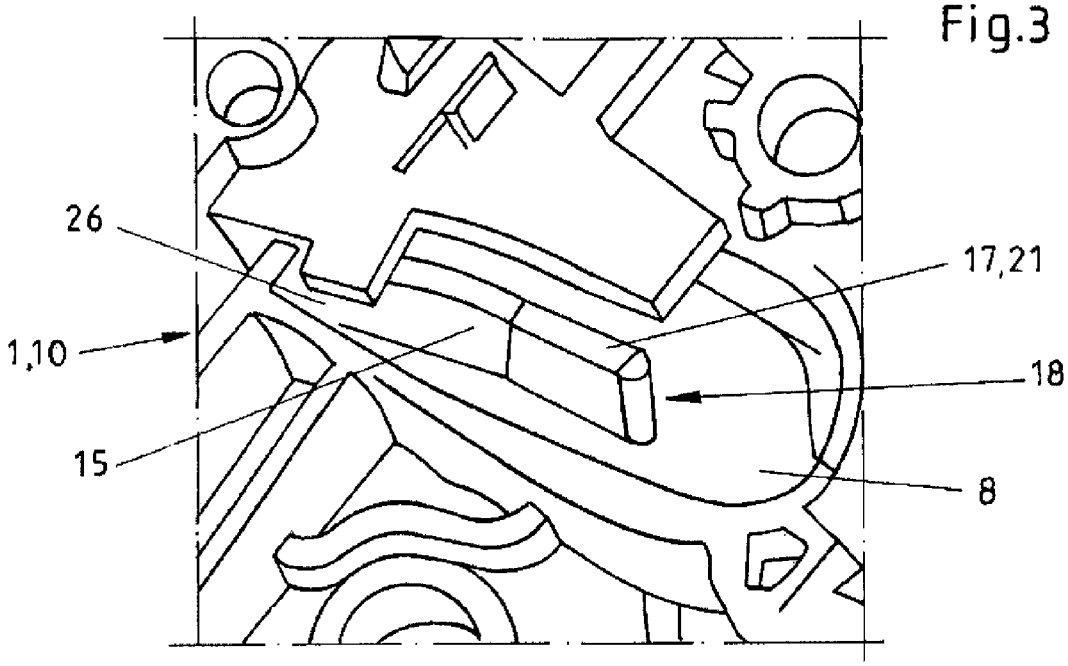
FIG. 3 shows a partial view with a covered spring lip.

The figure shows a bounding bead 20 representing the absolute end section of the spring lip 15. FIG. 2 does, however, not show said creaking protection 17, which is shown in FIG. 3. In this figure, the creaking protection 17 consisting of a metal clamp 21, is pushed onto the seat area also shown in FIG. 2. Further details of this metal clamp 21 are shown in the other figures. The numeral 26 indicates the fixing point of the spring lip 15 at the lock housing 10.

FIG. 4 shows a separate view of the spring lip 15. The figure shows that a bounding bead 20 is formed at the free end 18 of the spring lip 15, which together with edge 27 ensures that once the metal clamp 21 has been slid on, said clamp retains its assumed seat even under respective loading from locking bolt 3.

To facilitate installation or sliding on of the metal clamp 21 the clamp contains two flexible flanks 24, 25 with engaging edges 29, 30 being formed at the end of these flanks 24, 25, i.e. at the open end 28 of the metal clamp 21. The exact shape of said edges is shown in FIG. 6 from where it is clearly apparent that they are bent outwards in such a way that sliding of the metal clamp 21 onto the spring lip 15 in the seat area 22 is facilitated considerably.

A particular embodiment of the metal clamp 21 is shown in FIGS. 6 and 7. One flank 24 has a continuous same width, whilst the other flank 25 in the top third 35 has the same width, but is narrower in the two remaining thirds 36 resulting in the formation of a web 37, favourably affecting the spring force for sliding on the clamp.

It has already been mentioned that FIG. 4 shows the spring lip 15 before the metal clamp 21 is slid on. The figure shows a top recess 32 and a bottom recess 33. This results in a continuous sliding surface 31 for the locking bolt 3 when, during the closing operation of the lock 1, the locking bolt is guided along spring lip 15 and by said lip into the slotted guide 8 and then into the infeed section 7 of the rotary latch 2. The recesses 32, 33 and the reduced cross section in the seat area 22 achieve that the locking bolt 3 is slid along the spring lip 15 without any hindrance with said spring lip 15 being in close contact and ensuring that the locking bolt 3 is guided to the wall of the rotary latch 2 and positioned against it.

FIG. 7 lastly shows a cross section of the spring lip 15 in the seat area 22 of the metal clamp 21, from which it is apparent that the back 34 of the spring lip 15 contains a longitudinal groove 39. This longitudinal groove 39 is cut into the top edge 40 of the spring lip 15. A corresponding bead 41 is formed in the metal clamp 21. This special arrangement also ensures the exact and, in particular, the exactly retained seat of the metal clamp 21 and it should lastly be pointed out again that the side 38 of the metal clamp 21 facing the locking bolt 3 is the side with the continuous flank 24.

All aforementioned characteristics including those only shown in the drawings are on their own and together regarded as important aspects of the invention.

The invention claimed is:

1. Lock for a motor vehicle or a building, said lock being equipped with a rotary latch (2) rotatably supported in the lock housing (10) about a locking bolt (3), wherein the lock housing (10) has a slotted guide (8) for the locking bolt (3), said slotted guide having at least one spring lip (15) on the insertion side, which spring lip reaches into the slotted guide and cushions the locking bolt (3) said spring lip having creaking protection (17) that partially covers the surface, characterised in that die spring lip (15) has a bounding bead (20) at its free end (18) and wherein the creaking protection (17) is designed as a metal clamp (21) that can be attached to the spring lip (15) in front of the bounding bead with a preload.

2. Lock according to claim 1, characterised in that the spring lip (15) is formed to provide a seat area (22) for the metal clamp (21) and has a respective smaller cross section in said seat area (22).

3. Lock according to one of the above claims, characterised in that the metal clamp (21) contains two flexible flanks (24, 25).

4. Lock according to claim 2, characterised in that the seat area (22) of the metal clamp (21) is restricted on one hand by the bounding bead (20) at the end and on the other hand, in the direction of the fixing point (26) by edge (27) arranged at the lock housing (10).

5. Lock according to one of the above claims, characterised in that the metal clamp (21) contains engaging edges (29, 30) bent away at both sides at the open end (28).

6. Lock according to one of the above claims, characterised in that the spring lip (15) in the seat area (22) of the metal clamp (21) contains a recess (32, 33) on both sides, dimensioned according to the metal thickness on the back (34) of the metal clamp (21) and, at the open end (28) according to the engaging edges (29, 30).

7. Lock according to one of the above claims, characterised in that one flank (25) of the metal clamp (21) narrows towards the open end (28).

8. Lock according to claim 7, characterised in that the flank (25) having a different width has a full width in the top third (35) starting from the back (34) and a width preferably reduced to 66% in the two remaining thirds (36) resulting in a centre web (37).

9. Lock according to claim 7, characterised in that the flank (24) of the metal clamp (21) with the width extending unchanged up to the open end (28) is arranged on the side (38) facing the locking bolt (3) of the spring lip (15).

10. Lock according to one of the above claims, characterised in that the spring lip (15) in the seat area (22) of the back (34) of the metal clamp (21) contains a longitudinal groove (39) and the metal clamp (21) a corresponding bead (41).

11. Lock according to one or several of the above claims, characterised in that the metal clamp (21) is made from thin-walled stainless steel.

* * * * *